US007134612B2

(12) United States Patent
Bertucci et al.

(10) Patent No.: US 7,134,612 B2
(45) Date of Patent: Nov. 14, 2006

(54) SUPPORT FOR DISPENSING DEVICE

(75) Inventors: Michael H. Bertucci, Gurnee, IL (US); Christopher F. Lang, Burlington, WI (US); Steven E. Schiller, Kenosha, WI (US)

(73) Assignee: Johnsondiversey, Inc., Sturtevant, WI (US)

( * ) Notice: Subject to any disclaimer, the term of this patent is extended or adjusted under 35 U.S.C. 154(b) by 273 days.

(21) Appl. No.: 10/710,306

(22) Filed: Jul. 1, 2004

(65) Prior Publication Data

US 2005/0145719 A1 Jul. 7, 2005

Related U.S. Application Data

(63) Continuation-in-part of application No. 10/707,533, filed on Dec. 19, 2003.

(51) Int. Cl.
*A62C 13/62* (2006.01)

(52) U.S. Cl. ..... 239/304; 239/289; 239/302; 239/333; 141/100; 141/104; 248/75

(58) Field of Classification Search ..... 239/146, 239/289, 302, 304, 305, 333, 337; 222/131, 222/133, 157; 141/9, 100, 104; 248/75, 248/79, 80, 81, 82, 89
See application file for complete search history.

(56) References Cited

U.S. PATENT DOCUMENTS

| | | | | |
|---|---|---|---|---|
| 4,681,244 | A | 7/1987 | Geddie | |
| 5,408,936 | A * | 4/1995 | Tseng | 108/42 |
| 5,497,967 | A * | 3/1996 | Gantois | 248/166 |
| 5,651,398 | A * | 7/1997 | Decker et al. | 222/133 |
| 6,158,673 | A * | 12/2000 | Toetschinger et al. | 239/305 |
| 6,363,977 | B1 | 4/2002 | Smeller et al. | |
| 6,532,998 | B1 | 3/2003 | Beldham et al. | |
| 2002/0040737 | A1 | 4/2002 | Beldham et al. | |
| 2002/0092925 | A1 | 7/2002 | Hubmann et al. | |
| 2002/0148907 | A1* | 10/2002 | You | 239/146 |
| 2003/0192618 | A1 | 10/2003 | Beldham et al. | |

FOREIGN PATENT DOCUMENTS

| | | |
|---|---|---|
| DE | G 87 01 170.0 | 5/1987 |
| EP | 0 366 444 | 2/1990 |
| WO | WO 97/26210 | 7/1997 |

* cited by examiner

*Primary Examiner*—Steven J. Ganey
(74) *Attorney, Agent, or Firm*—Neil E. Hamilton; James J. Sales; Renee J. Rymarz

(57) ABSTRACT

An apparatus for supporting a hand held liquid dispensing device which affords a storage capability for the device as well as affords the filling of containers and buckets. In a preferred manner the apparatus provides for the support of two dispensing devices and the filling of two containers or one container and a bucket. In another preferred manner, the apparatus provides for two supports for the dispensing device and one for a container.

27 Claims, 10 Drawing Sheets

SUPPORT FOR DISPENSING DEVICE

BACKGROUND OF INVENTION

Technical Field

This invention relates to a support for a hand held dispensing device. More particularly, it relates to a support for a hand held liquid dispensing device which includes a container support and facilitates the filling of a container as well as affords connection to a dispensing hose for filling a bucket.

The prior art does not provide a support or holder for hand held liquid dispensing devices. There is a need for such an apparatus. The type of hand held liquid dispensing devices concerned with in this invention are those which are attached to a hose and a container with liquid concentrate. Such a device is described in U.S. Pat. No. 6,708,901, which teachings are incorporated herein by reference. This type of dispenser dispenses cleaning, disinfectants and similar types of materials. After use, it is desirable to have a place to store the dispenser. It would also be desirable to have a storage apparatus which would also allow for the filling of containers and buckets with diluted concentrate while the dispenser is being stored.

SUMMARY OF INVENTION

The present invention provides an apparatus for supporting a hand held liquid dispensing device. The apparatus includes a first support member for receiving a nozzle portion of the dispensing device. There is a second support member for holding a container, the first and second support members are spaced from each other in substantial axial alignment and connected to a frame member for connection to a supporting structure.

In a preferred embodiment, the first support member includes a cavity.

In another preferred embodiment, there are two oppositely disposed first support members connected to the frame member.

In one aspect, the first support member is defined by a platform having a cavity for placement of a dispenser nozzle therein and the second support member is defined by a foot portion, the foot portion supported by the frame and pivotally connected to the frame member.

In another aspect, there are two oppositely disposed second support members connected to the frame member. The frame member is defined by a first portion extending in a first direction and a second portion extending essentially at right angles to the first portion with the second portion connected to the two oppositely disposed second support members.

In still another aspect, the invention provides a combined hand held dispenser device and apparatus for supporting the device.

In yet another aspect, the frame member includes a third support member as well as a side portion connected to the third support member with the side portion angling inwardly from the third support member toward the first support member.

The objects of some of the embodiments of the invention therefore are:

a) Providing an apparatus for storing and supporting a hand held liquid dispensing apparatus;

b) Providing an apparatus for storing and supporting a hand held liquid dispensing apparatus which is easily utilized;

c) Providing an apparatus of the foregoing type which facilitates the filling of containers;

d) Providing an apparatus of the foregoing type which can accommodate two dispensing devices;

e) Providing an apparatus of the foregoing type which can be economically manufactured;

f) Providing an apparatus of the foregoing type which affords a secure holding of the dispensing apparatus;

g) Providing a temporary plumbed installation by mans of a water hose; and h) Providing bottle filling drip trays that fold up for bucket filling.

DETAILED DESCRIPTION

Figure 1:
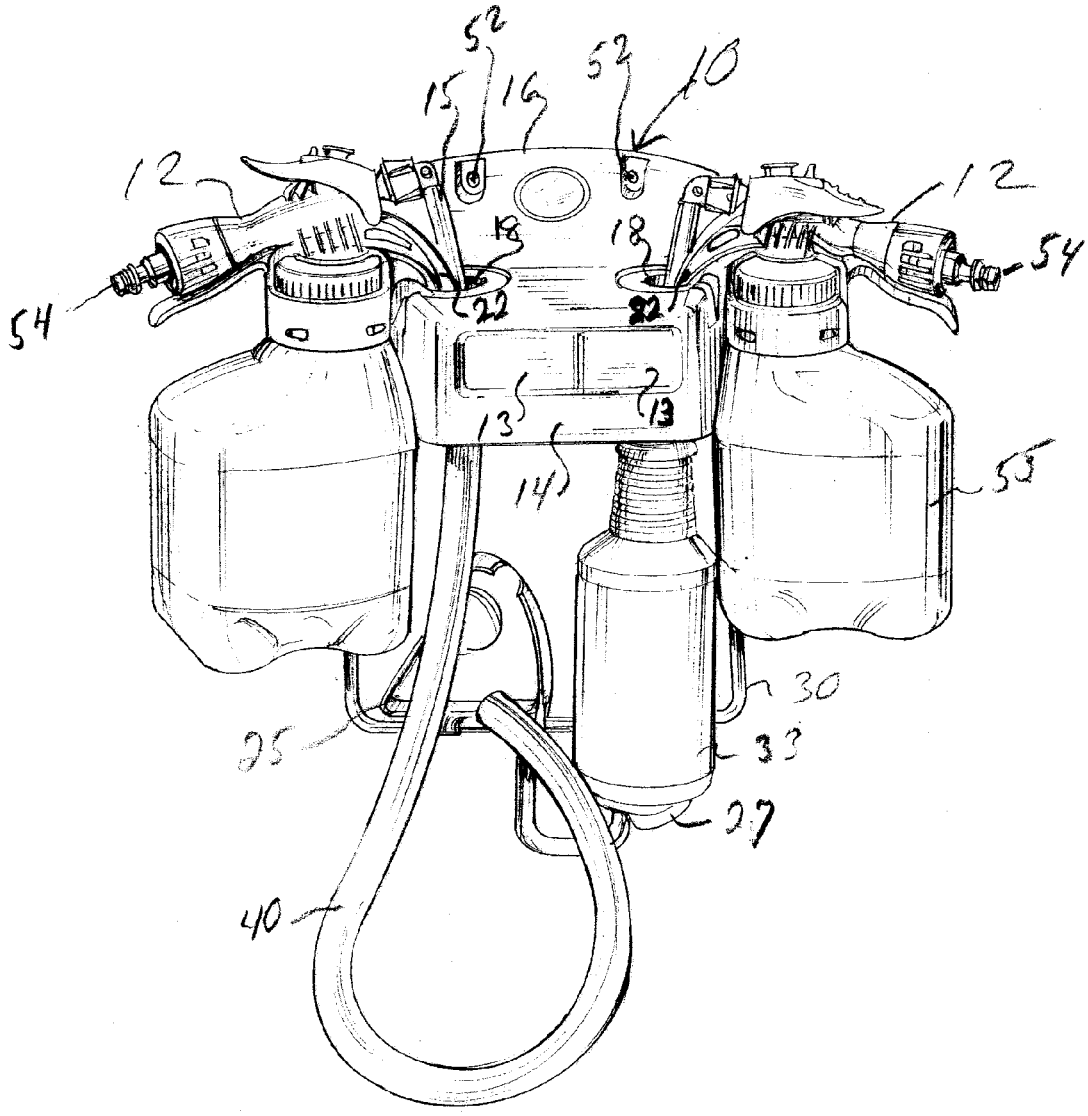
FIG. 1 is a perspective view of the support for dispensing device of the invention as well as two dispensing devices.
Figure 2:
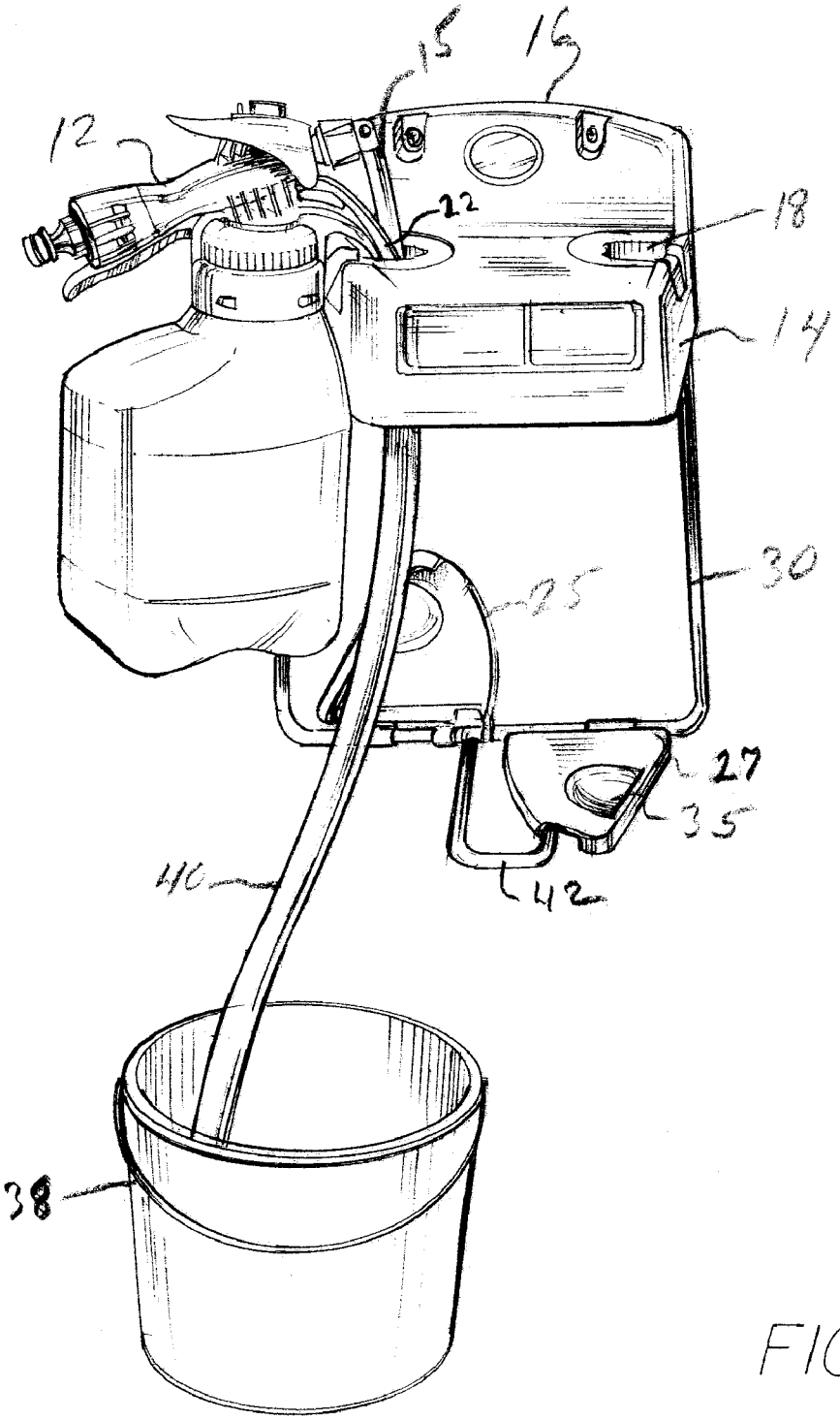
FIG. 2 is a front view of the support for a dispensing device showing the filling of a bucket.
Figure 3:
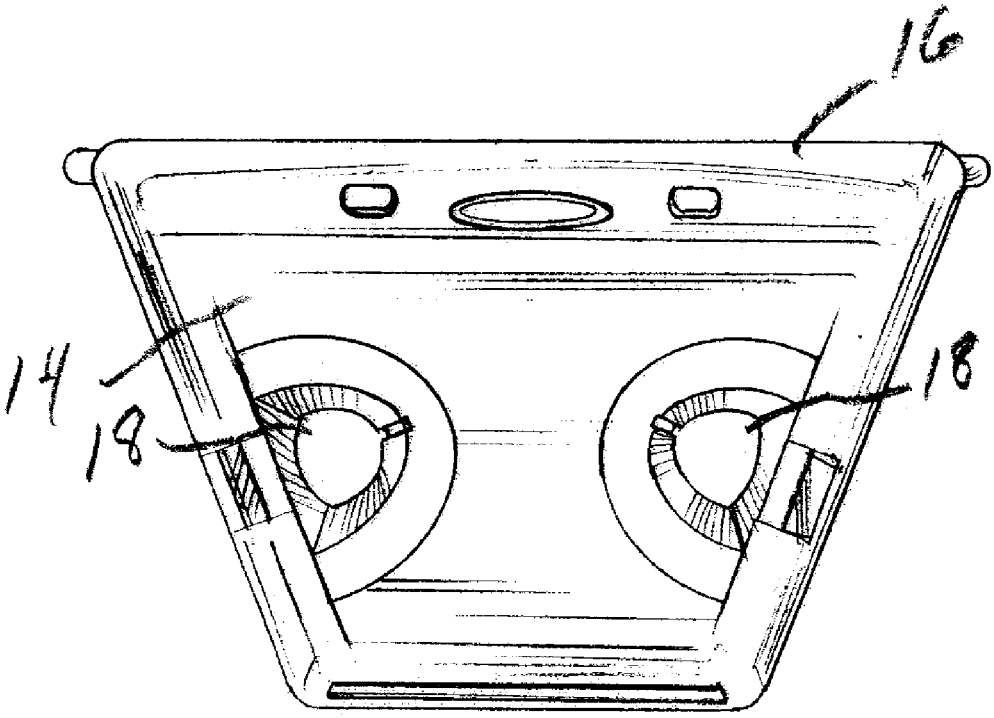
FIG. 3 is a top view of the support for a dispensing device.

Referring to FIGS. 1–4, the support apparatus generally 10 is illustrated in conjunction with a dispensing device 12. The dispensing device was previously referred to above as described in U.S. Pat. No. 6,708,901. The support apparatus 10 includes a platform 14 and a back wall 16, as well as cavities 18 providing a first support member which receive the spout 22 of the dispensing device 12. The platform 14 has indented panels 13 which afford an area for placement of product identification labels to indicate the materials being dispensed from the dispenser bottle 55. There are also foot portions 25 and 27 providing a second support member which are pivotally attached to a frame 30 for purposes of supporting containers such as bottle 33 and provide a drip tray when a bottle is not present. These foot portions 25 and 27 have indentations 35 so as to accommodate the bottoms of a bottle such as 33. As seen in FIGS. 1 and 2, there is a hose 40 which is attached to the dispensing tube 15 of dispenser 12 for the purpose of filling bucket 38.

Figure 4:
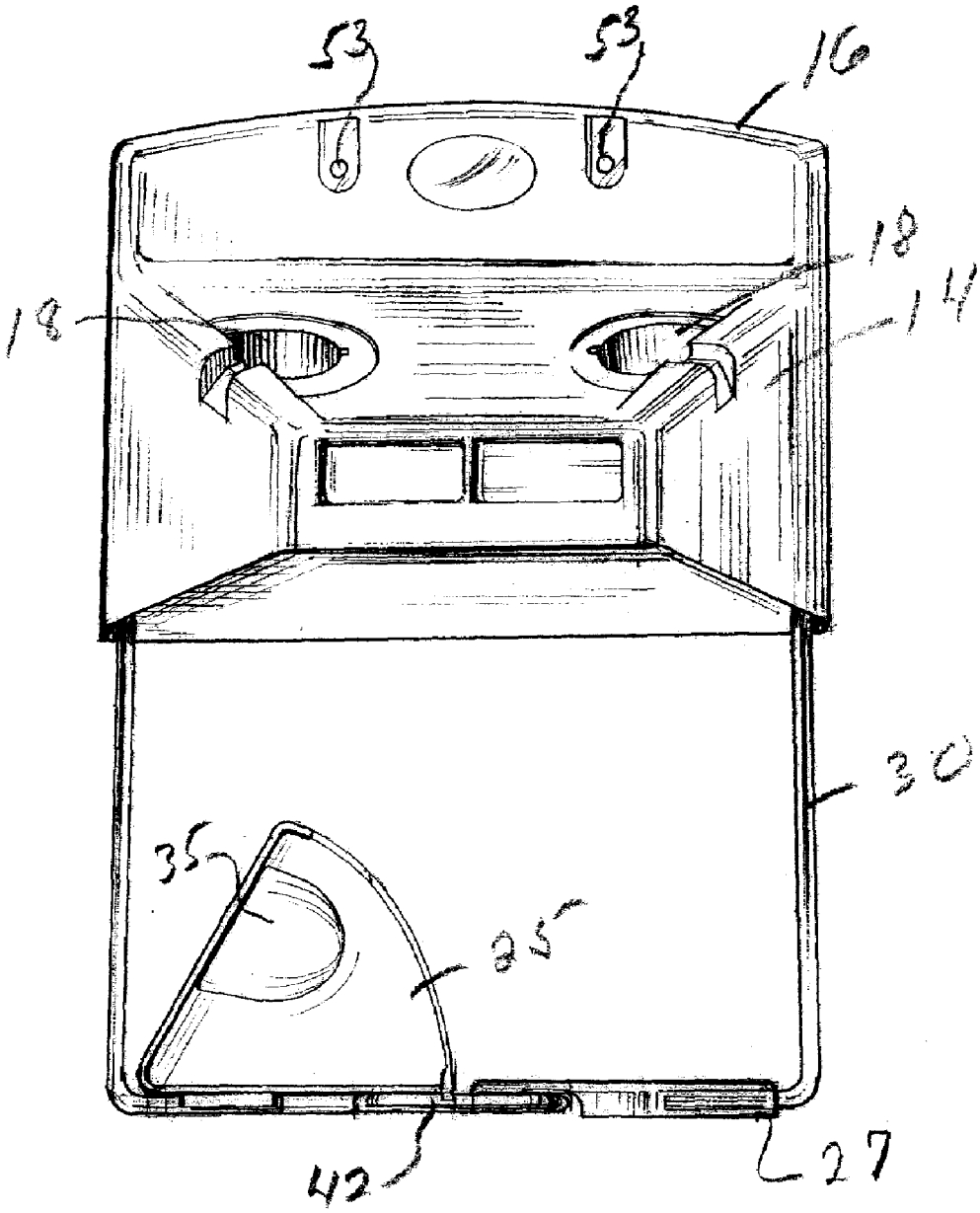
FIG. 4 is a front view of the support for a dispensing device without any attachments.
Figure 5:
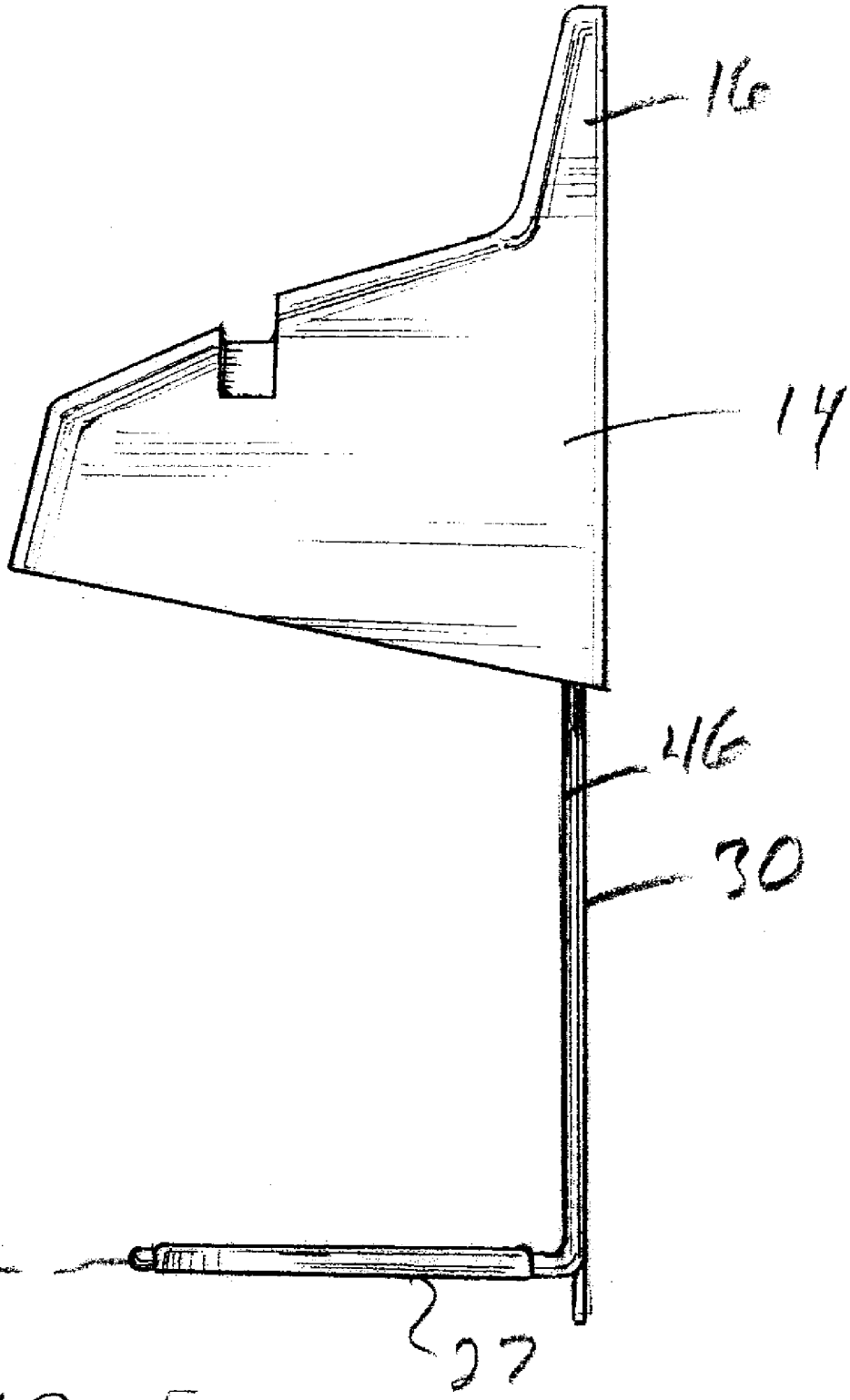
FIG. 5 is a side view of the support for a dispensing device.
Figure 6:
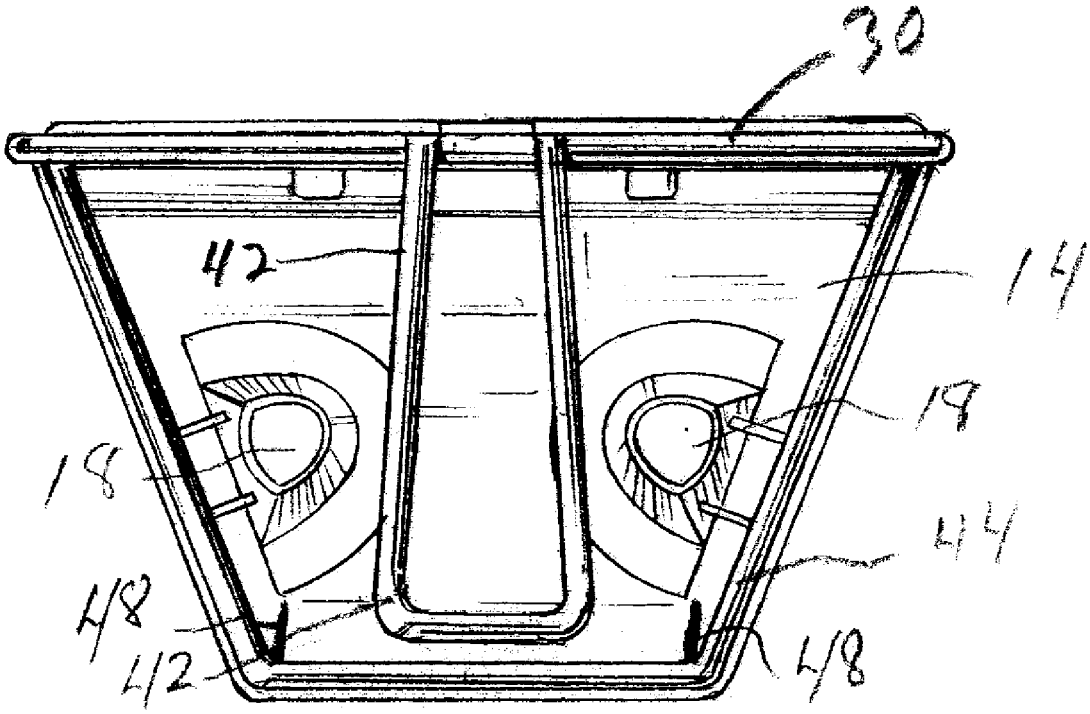
FIG. 6 is a bottom view of the support for a dispensing device.
Figure 7:
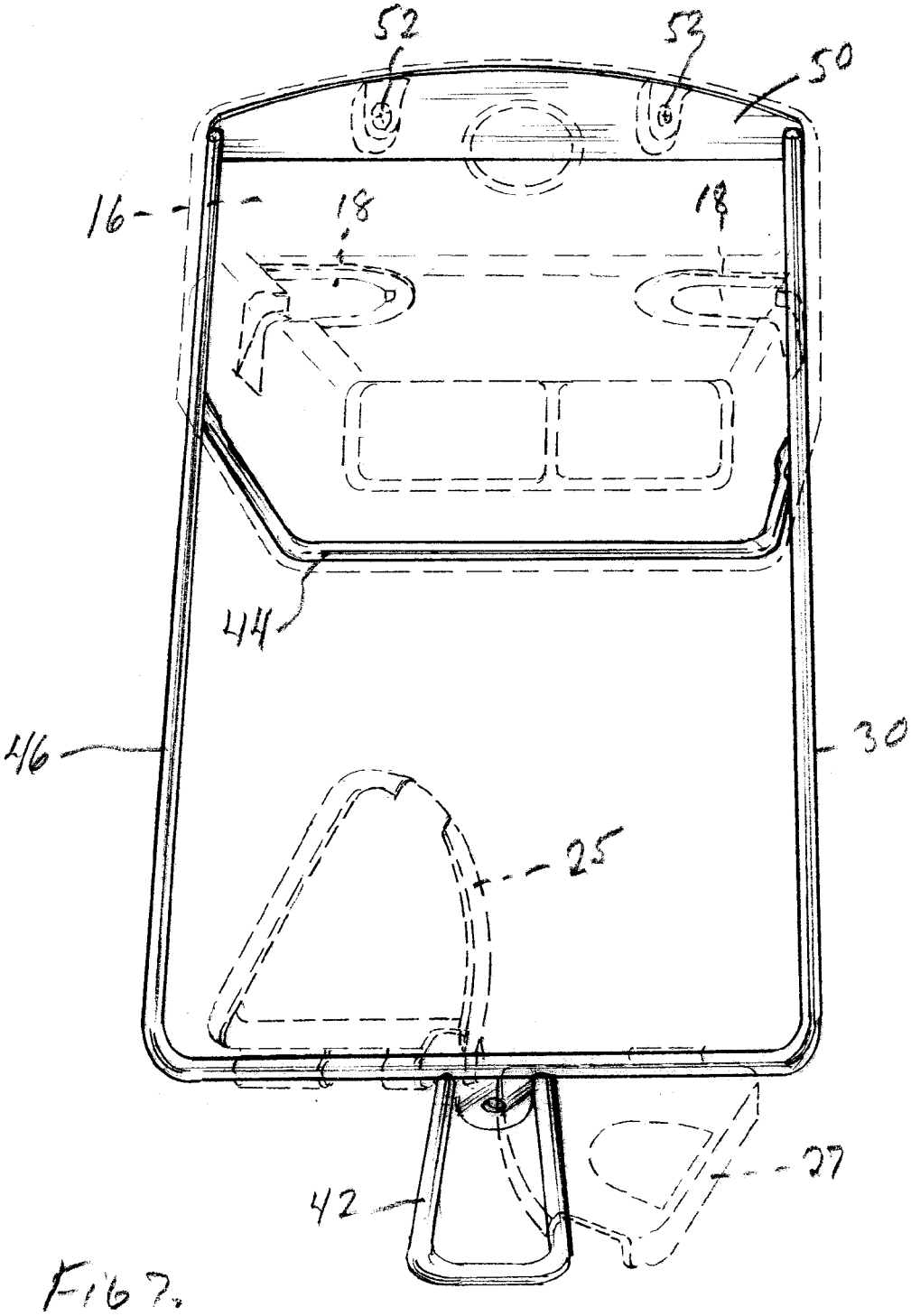
FIG. 7 is a front view with a portion shown in phantom illustrating the supporting structure for the dispensing device.

Referring to FIGS. 5–7, it is seen that the frame 30 includes a second portion 42 extending essentially at a right angle to a vertical first portion 46 of frame 30. This portion 42 supports the foot portions 25 and 27 which they are pivotally attached to frame 30. As best seen in FIG. 6, frame 30 includes an additional U-shaped portion 44 supporting the platform 14 as by contact with the projections 48. As seen in FIG. 7, there is connected to the frame 30 a cross-bar member 50 extending behind the wall 16 through which mounting screws 52 can be inserted, such as through the holes 53 as seen in FIG. 4.

Figure 8:
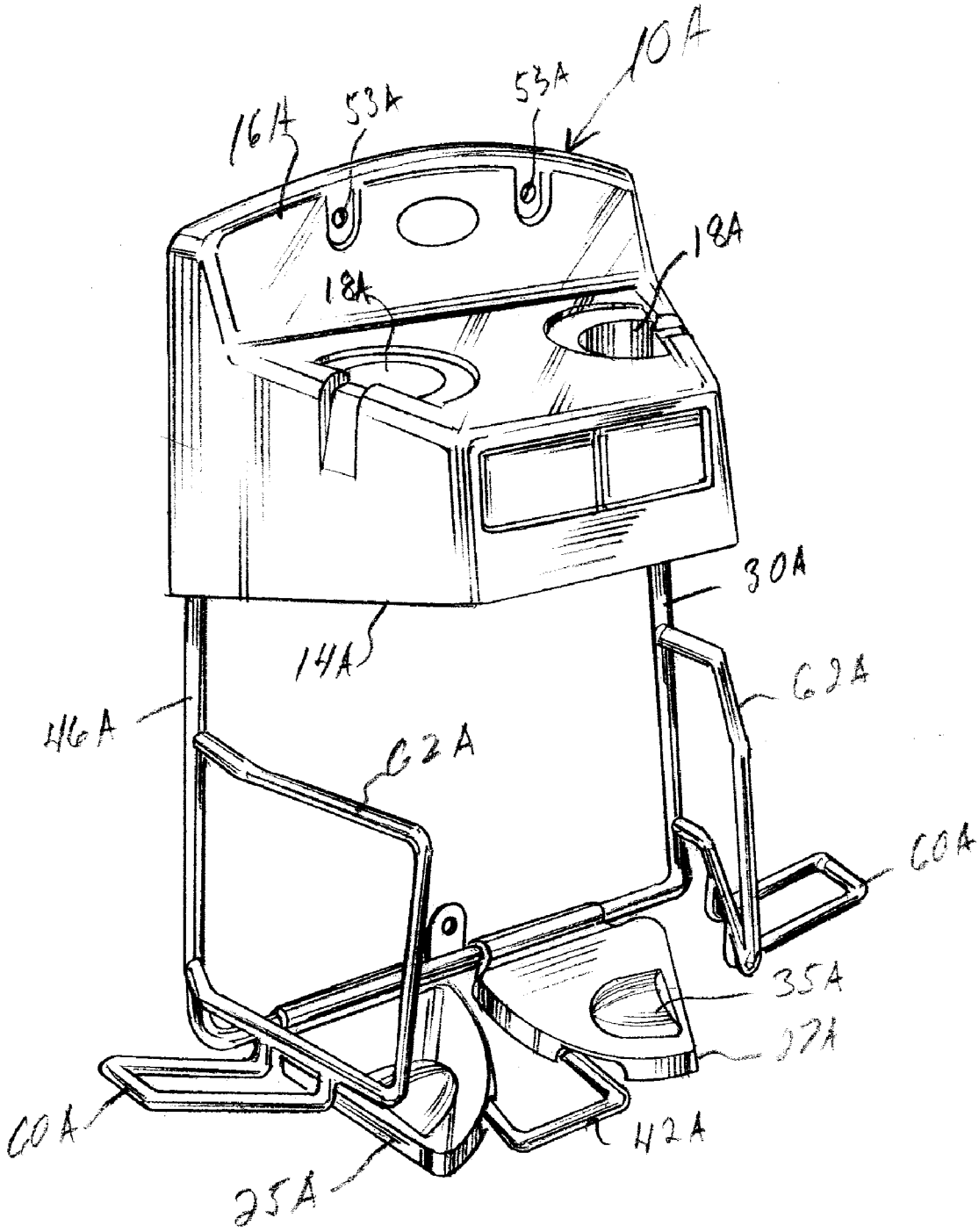
FIG. 8 is a perspective view of a second embodiment of the support for a dispensing device.
Figure 9:
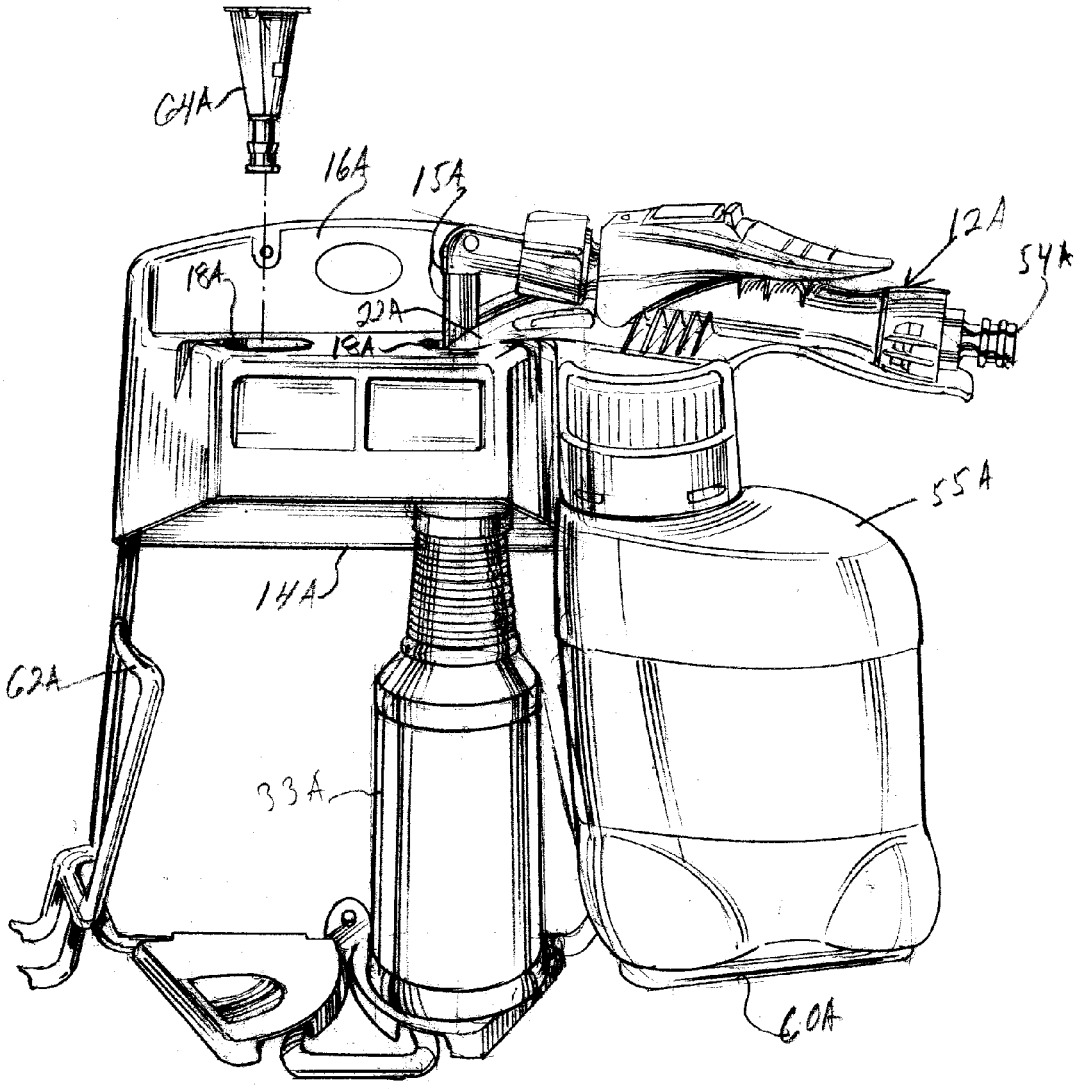
FIG. 9 is a front view of the embodiment shown in FIG. 8 with a dispensing device and bottle supported thereon.
Figure 10:
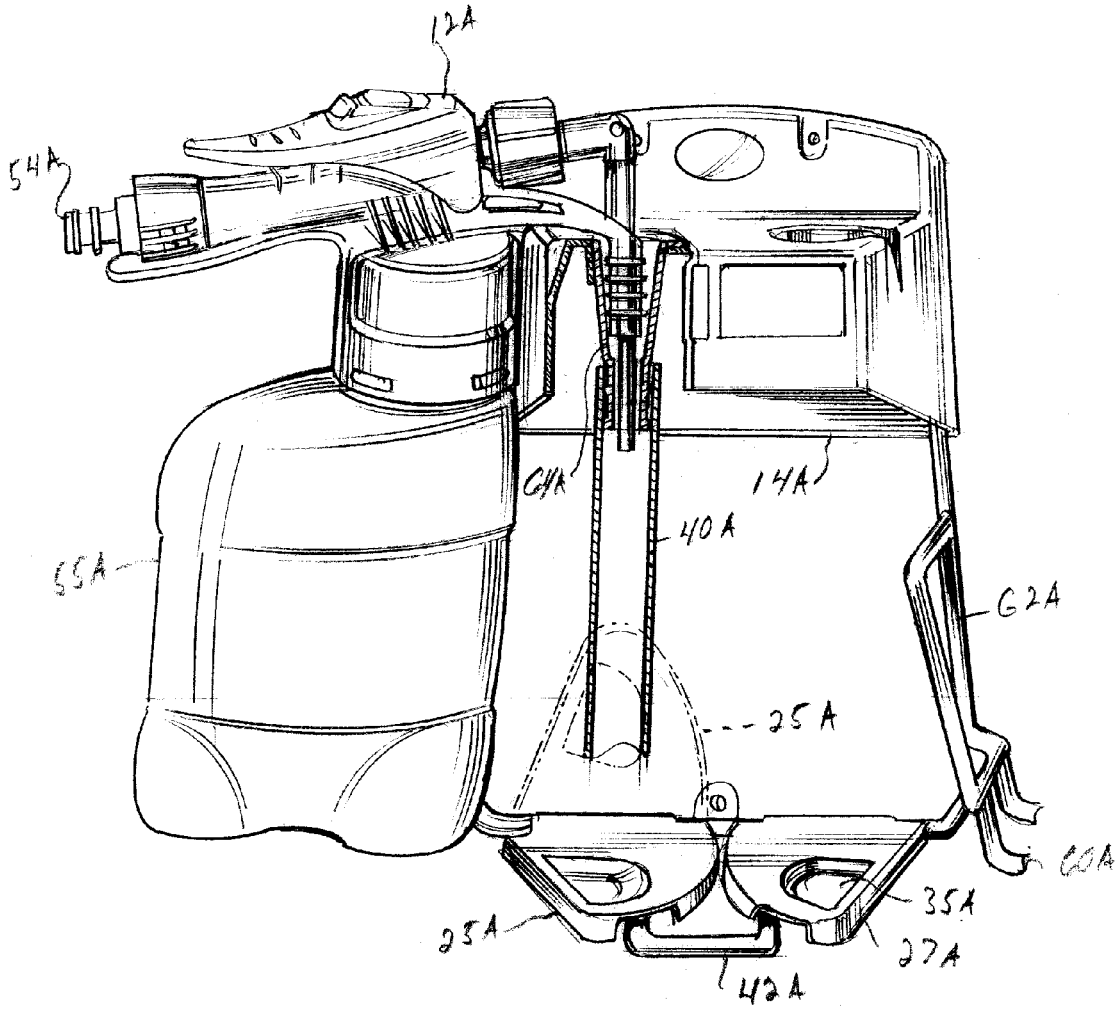
FIG. 10 is a view similar to FIG. 9 illustrating the connection of the dispensing device to a hose.

FIGS. 8–10 illustrate a second embodiment generally 10A of the support apparatus. The same reference numerals are employed as previously with respect to similar elements and embodiment 10, except they include the "A" suffix. One of the differences between support apparatus 10 and 10A is an additional third support member 60A and the side portions 62A of the frame 30A. It should be noted that the side portions 62A angle inwardly in a direction from the third support member 60A toward the first support member in the form of platform 14A. This provides additional support for dispenser bottle 55A in addition to the support provided by the spout 22A positioned in cavity 18A. Another difference is the funnel 64A. This affords efficient transfer of liquid material from the dispensing device 12A into the hose 40A for bucket filling.

Operation

A better understanding of the support apparatus 10 will be had by a description of its operation. Referring to FIGS. 1 and 2, support apparatus 10 is mounted to a wall such as by the mounting screws 52. Dispensing devices 12 are supported by the support apparatus, such as by the placement of spouts 22 in the cavities 18. Water supply hoses (not shown) are connected to the connectors 54 such as by means of complementary disconnect devices (not shown). When it is desired to fill bottle 33, it is placed on foot portion 27. The bottle 33 can then be easily filled from the dispensing device 12 with a solution of the concentrate from the dispenser bottle 55 and the water. In the instance where it is desired to fill the bucket 38, the foot portion 25 is pivoted to an away position such as shown in FIG. 2. This affords a direct path for the hose 40 which is connected to the dispensing tube 15 of the dispensing device 12. In those instances where two bottles 33 are desired to be filled, foot portion 25 will assume a similar position as shown for foot portion 27. In a like manner, it will be supported by the frame portion 42.

The operation of support apparatus 10A is essentially the same as that described for support apparatus 10. The major difference, as previously described, is the support of the bottle 55A by the support members 60A and the side portions 62A and the presence of the funnel member 64A for bucket filling. In those instances where the bottle 55A is not of a size to rest on support member 60A, a smaller bottle would be supported by the angled side portions 62A.

It will thus be seen that there now is provided a supporting apparatus for dispensing devices, such as 12, in a manner that they are not only conveniently supported in an out-of-the-way position, but at the same time afford ease of filling of either a bottle 33 or a bucket 38.

The preferred material for fabricating platform 14, as well as foot portions 25 and 27 is polypropylene. However, other materials such as acetyl resins and glass filled polypropylene could also be employed. Frame member 30 is composed of a steel bar with frame portion 42 being welded thereto as is portion 44 and the bar member 50. The preferred material for composing frame 30 is steel. However, other materials such as stainless steel and nylon could also be utilized. While the support apparatus 10 has been illustrated for use with the foot portions 25 and 27 which could support two bottles 33 and alternatively provide for a connection support to the hose 40, it is readily apparent that the support apparatus could be designed for supporting only a single dispensing device and a single container 33 placed on foot portion 27. When it is desired to fill a bucket 38 foot portion 27 is moved to an up-right position with connection to the hose 40 to the dispensing tube 15. All such and other modifications within the spirit of the invention are meant to be within its scope, as defined by the appended claims.

The invention claimed is:

1. An apparatus for supporting a hand held liquid dispensing device comprising:

at least one first support member for receiving a nozzle portion of the dispensing device; and at least one second support member for holding a container, the at least first and second support members being spaced from each other in substantial axial alignment and connected to a frame member for connection to a supporting structure the at least first support member constructed and arranged to facilitate the filling of the container when the nozzle portion is placed in the at least first support member and a container is placed on the at least second support member in one instance and the at least second support member being displaceable in another instance to provide a hose connection to the nozzle portion for filling of a bucket.

2. The apparatus as defined in claim 1 wherein the at least one first support member includes a cavity.

3. The apparatus as defined in claim 2 wherein the cavity includes a passage constructed and arranged to permit passage of the nozzle portion therethrough.

4. The apparatus as defined in claim 1 wherein the at least one second support member is pivotably connected to the frame member.

5. The apparatus as defined in claim 1 wherein there are two oppositely disposed at least one first support members connected to the frame member.

6. The apparatus as defined in claim 1 wherein the at least one first support member is defined by a platform having a cavity for placement of the nozzle portion of the dispensing device therein.

7. The apparatus as defined in claim 1 wherein the at least one second support member is defined by a foot portion, the foot portion supported by the frame and pivotally connected to the frame member.

8. The apparatus as defined in claim 7 wherein tbe foot portion includes a concave portion for receiving a bottle.

9. The apparatus as defined in claim 1 wherein there are two oppositely disposed at least one second support members connected to the frame member, the frame member defined by a first portion extending in a first direction and a second portion extending essentially at right angles to the first portion, the second portion connected to the two oppositeJy disposed second support members.

10. The apparatus as defined in claim 9 wherein the frame member is composed of rod members.

11. A combined hand held liquid dispensing device and apparatus for supporting the device comprising:

a liquid dispensing device;

at least one first support member receiving a nozzle portion of the dispensing device; and at least one second support member for holding a container, the at least first and second support members being spaced from each other in substantial axial alignment and connected to a frame member for connection to a supporting structure the at least first support member constructed and arranged to facilitate the filling of the container when the nozzle portion is placed in the at least first support member and a container is placed on the at least second support member in one instance and the at least second support member being displaceable in another instance to provide a hose connection to the nozzle portion for filling of a bucket.

12. The apparatus as defined in claim 11 wherein the at least one first support member includes a cavity.

13. The apparatus as defined in claim 12 wherein the cavity includes a passage constructed and arranged to permit passage of the nozzle portion therethrough.

14. The apparatus as defined in claim 11 wherein the at least one second support member is pivotably connected to the frame member.

15. The apparatus as defined in claim 11 wherein there are two oppositely disposed first support members connected to the frame member.

16. The apparatus as defined in claim 11 wherein the at least one first support member is defined by a platform having a cavity for placement of the nozzle portion of the dispensing device therein.

17. The apparatus as defined in claim 11 wherein the at least one second support member is defined by a foot portion, the foot portion supported by the frame and pivotally connected to the frame member.

18. The apparatus as defined in claim 17 wherein the foot portion includes a concave portion for receiving a bottle.

19. The apparatus as defined in claim 11 wherein there are two oppositely disposed at least one second support members connected to the frame member, the frame member defined by a first portion extending in a first direction and a second portion extending essentially at right angles to the first portion, the second portion connected to the two oppositely disposed second support members.

20. The apparatus as defined in claim 19 wherein the frame member is composed of rod members.

21. An apparatus for supporting a hand held liquid dispensing device comprising:

at least one first support member for receiving a nozzle portion of the dispensing device; and at least one second support member for holding a container, the at least first and second support members being spaced from each other in substantial axial alignment and connected to a frame member for connection to a supporting structure, the frame member including at least one third support member for the dispensing device the at least one first support member constructed and arranged to facilitate the filling of the container when the nozzle portion is placed in the at least one first support member and a container is placed on the at least one second support member in one instance and the at least one second support member being displaceable in another instance to provide a hose connection to the nozzle portion for filling of a bucket.

22. The apparatus as defined in claim 21 wherein the frame member includes at least one side portion connected to the at least one third support member.

23. The apparatus as defined in claim 22 wherein the at least one side portion angles inwardly in a direction from the at least one third support member toward the at least one first support member.

24. The apparatus as defined in claim 21 wherein there are two oppositely disposed first, second and third support members connected to the frame member.

25. The apparatus as defined in claim 21 wherein the at least one second support member is pivotally connected to the frame member.

26. An apparatus for supporting a hand held liquid dispensing device comprising:

at least one first support member for receiving a nozzle portion of the dispensing device;

at least one second support member for holding a container, the first and second at least one support members being spaced from each other in substantial axial alignment and connected to a frame member for connection to a supporting structure, the at least one second support member being pivotally connected to the frame member, the frame member including at least one third support member for the dispensing device; and a funnel for placement in the at least one first support member and the at least one second support member being pivotally connected to the frame member.

27. An apparatus for supporting a hand held liquid dispensing device comprising:

at least one first support member for receiving a nozzle portion of the dispensing device; and at least one second support member for holding a container, the at least one first and second support members being spaced from each other in substantial axial alignment and connected to a frame member for connection to a supporting structure, the frame member including at least one third support member for the dispensing device, the frame member further including at least one side portion connected to the at least one third support member with the at least one side portion angling inwardly in a direction from the at least one third support member toward the at least one first support member and wherein the at least one side portions are constructed and arranged to accommodate containers of different sizes.

* * * * *